US012257489B2

(12) United States Patent
Conte et al.

(10) Patent No.: US 12,257,489 B2
(45) Date of Patent: Mar. 25, 2025

(54) METHOD OF MANUFACTURING A FRAME FOR AN ICE SKATE BOOT

(71) Applicant: HD SPORTS LIMITED, Sheffield (GB)

(72) Inventors: Stefano Conte, Paese (IT); Tom Cantwell, Sheffield (GB); Robert P. Donahoe, Sheffield (GB); Paul Harrity, Sheffield (GB); Liam Rains, Sheffield (GB)

(73) Assignee: HD SPORTS LIMITED, Sheffield (GB)

( * ) Notice: Subject to any disclaimer, the term of this patent is extended or adjusted under 35 U.S.C. 154(b) by 872 days.

(21) Appl. No.: 17/243,039

(22) Filed: Apr. 28, 2021

(65) Prior Publication Data

US 2021/0331061 A1 Oct. 28, 2021

(30) Foreign Application Priority Data

Apr. 28, 2020 (GB) ..... 2006252

(51) Int. Cl.
*A63C 1/42* (2006.01)
*A63C 1/22* (2006.01)

(52) U.S. Cl.
CPC . *A63C 1/42* (2013.01); *A63C 1/22* (2013.01)

(58) Field of Classification Search
CPC .... A63C 1/42; A63C 1/22; A63C 1/40; A63C 1/02
See application file for complete search history.

(56) References Cited

U.S. PATENT DOCUMENTS 4,053,168 A * 10/1977 Goverde ..... A63C 1/42 280/11.12
4,251,086 A 2/1981 Wooley
(Continued)

FOREIGN PATENT DOCUMENTS

CN 105903173 A 8/2016

OTHER PUBLICATIONS

Search Report received in GB Application No. 2006252.7 dated Sep. 22, 2020.

(Continued)

*Primary Examiner* — Rick K Chang
(74) *Attorney, Agent, or Firm* — Greer, Burns & Crain, Ltd

(57) ABSTRACT

A method of manufacturing a frame for an ice skate boot, the method including:

a) moulding a substantially T-shaped body having a first plate and a second plate extending substantially perpendicularly from the first plate;

b) milling the first plate to form a platform intended to be uppermost on the frame, in use, for supporting an ice skate boot, the platform having a first support for supporting a forward portion of an ice skate boot and a second support, separate from the first support, for supporting a rearward portion of an ice skate boot;

c) milling the second plate to form an elongate body defining an elongate length of the frame, the elongate body having first and second arms extending from the elongate body, where distal ends of the first and second arms are connected to the first and second supports, respectively; and d) forming a mounting arrangement on the elongate body for mounting a blade runner to the elongate body, (Continued)

wherein step a) includes the step of integrally forming the first and second plates from a composite material.

19 Claims, 3 Drawing Sheets

(56) References Cited

U.S. PATENT DOCUMENTS

| | | | | |
|---|---|---|---|---|
| 4,295,655 | A * | 10/1981 | Landay | A63C 1/02 280/11.209 |
| 2003/0234499 | A1 | 12/2003 | Rudolph | |
| 2004/0140631 | A1 | 7/2004 | Goldsmith et al. | |
| 2006/0043686 | A1 | 3/2006 | Rudolph | |
| 2017/0361200 | A1* | 12/2017 | Chartrand | A63C 1/42 |
| 2019/0269997 | A1 | 9/2019 | Labonte et al. | |

OTHER PUBLICATIONS

Combined Search and Examination Report UK Application No. GB2408422.0, dated Jul. 4, 2024.

* cited by examiner

METHOD OF MANUFACTURING A FRAME FOR AN ICE SKATE BOOT

FIELD

The present teachings relate to a frame for an ice skate boot, and to a method of manufacturing a frame.

BACKGROUND

Ice skates for use in figure skating utilise a common structure including an ice skate support frame having front and rear supports for supporting an ice skate boot, and having an elongate blade runner which engages the ice when the ice skate is in use. For figure skating, it is particularly desirable to have a lightweight ice skate to make it easy for a user to move about freely and perform jumps etc. Traditionally, ice skate support frames have been made from steel, but such frames have also been manufactured using aluminium and titanium to help to reduce the weight of the ice skates. More recently, ice skate support frames have been manufactured using a range of different materials, but these support frames have often been found to be difficult and expensive to manufacture, whilst retaining the required mechanical strength.

The present teachings seek to overcome or at least mitigate one or more problems associated with the prior art.

SUMMARY

A first aspect of the teachings provides a frame for an ice skate boot, the frame comprising: an elongate body comprising a mounting arrangement for mounting a blade runner to the elongate body; and a platform intended to be uppermost on the frame, in use, for supporting an ice skate boot thereon, said platform comprising a first support for supporting a forward portion of an ice skate boot and a second support, separate from the first support, for supporting a rearward portion of an ice skate boot, wherein the elongate body comprises first and second arms extending therefrom, the first and second supports being connected to distal ends of the first and second arms, respectively, and wherein the platform and elongate body are integrally formed from a composite material.

The support frame platform includes a first support for supporting a forward, or sole, portion of an ice skate boot and a second support for supporting a rearward, or heel, portion of an ice skate boot. Traditionally, a support frame for an ice skate would be formed from several steel components that are welded together. However, in the above arrangement, the frame body and the platform (i.e. the first and second supports) are formed as a unitary body from a composite material. Through the above arrangement, the weight of the support frame can be reduced (for example by up to 50% compared to a traditional steel support frame). Moreover, the formation of the support frame as a unitary body helps to reduce the number of manufacturing steps involved.

The composite material may comprise a fibre, e.g. carbon fibre, reinforced composite material.

The use of carbon fibre reinforced composite materials can provide the equivalent stiffness and strength as the traditional steel structure at a much lighter weight. Thus, the present arrangement further increases the structural strength of the support frame material, enabling the mass, and so weight, of the support frame to be further reduced.

The composite material may comprise a fibre, e.g. carbon fibre, reinforced resin, e.g. epoxy, material.

The use of carbon fibre reinforced composite materials can provide the equivalent stiffness and strength as the traditional steel structure at a much lighter weight. Thus, the present arrangement further increases the structural strength of the support frame material, enabling the mass, and so weight, of the support frame to be further reduced.

The elongate body may define a profile in cross-section. The elongate body profile may define a width decreasing from a maximum adjacent to the platform to a minimum adjacent to an edge of the elongate body distal to said platform.

The cross-sectional width of the frame body decreases in a direction away from the platform. The junction between the frame body and the platform is exposed to very high amounts of stress during ice skating. Tapering the width of the frame body enables the junction region to be sufficiently wide to handle these stresses, whilst reducing the thickness in regions away from said junction. This reduces the material needed for the support frame and so reduces the weight of said support frame.

The elongate body may define a profile in cross-section. The elongate body may comprise a clamping region in which opposing sides of the body profile are substantially parallel.

The clamping region is one in which the cross-sectional profile of the frame body has opposing outer surfaces that are parallel. The provision of this parallel region enables the support frame to be easily clamped, e.g. for maintenance of the blade runner.

The clamping region may extend generally along the entire longitudinal length of the elongate body.

This provides a greater area for clamping onto, and so facilitates maintenance of the blade runner.

The elongate body may define a profile in cross-section. The width of the profile is tapered in a direction from the platform to the clamping region.

The elongate body may define a profile in cross-section. The width of the profile is tapered in a direction from the clamping region to an edge of the elongate body distal to the platform.

The mounting arrangement may comprise a longitudinal slot extending generally along a longitudinal edge of the elongate body distal to said platform.

The longitudinal slot may extend generally along the entire longitudinal length of the elongate body.

The slot may comprise a depth in the range 5-15 mm, for example the slot comprises a depth of approximately 10 mm.

Providing a slot or recess with a depth in this range has been found to provide a sufficient contact area between the blade runner and the body to provide a strong bond (e.g. via an adhesive) therebetween.

A blade runner, e.g. a steel blade runner, may be removably mounted to the mounting arrangement.

Providing a blade runner, e.g. a metal such a steel blade runner, that is removably mounted to the frame body enables the blade runner to be removed/replaced for maintenance.

The blade runner may comprise a first region defining a first width substantially the same as a width of the slot, and a second region intended to be positioned below the first region, in use, and defining a second width greater than the first width.

The blade runner may form a shoulder between the first and second regions, and wherein said shoulder may be arranged to abut against the distal edge of the elongate body portion.

The blade runner may be mounted to the mounting arrangement via an adhesive.

The blade runner may be mounted to the mounting arrangement via one or more fasteners.

This enables the blade runner to be manufactured as a separate component to the body but to be able to be strongly attached thereto.

The blade runner and the elongate body portion may each comprise one or more apertures, and wherein each aperture of the elongate body portion may be arranged to align with a corresponding aperture of the blade runner for receiving a fastener therethrough.

The platform and elongate body may be arranged substantially perpendicularly such that the frame is substantially T-shaped in cross-section.

The platform and elongate body may be integrally formed through injection moulding and/or compression moulding.

A second aspect of the teachings provides a method of manufacturing a frame for an ice skate boot, the method comprising: a) moulding a substantially T-shaped body comprising a first plate and a second plate extending substantially perpendicularly from said first plate; b) milling the first plate to form a platform intended to be uppermost on the frame, in use, for supporting an ice skate boot, said platform comprising a first support for supporting a forward portion of an ice skate boot and a second support, separate from the first support, for supporting a rearward portion of an ice skate boot; c) milling the second plate to form an elongate body defining an elongate length of the frame, said elongate body comprising first and second arms extending from the elongate body, where distal ends of said first and second arms are connected to the first and second supports, respectively; and d) forming a mounting arrangement on the elongate body for mounting a blade runner to the elongate body, wherein step a) comprises the step of integrally forming the first and second plates from a composite material.

The first and second plates may be formed by injection moulding or compression moulding.

The method may comprise the step of mounting a blade runner to the mounting arrangement.

The method may comprise the step of integrally moulding the blade runner into the T-shaped body in step a).

A third aspect of the teachings provides a method of manufacturing a frame for an ice skate boot, the method comprising: a) moulding a frame from a composite material, the frame comprising an elongate body, and a platform intended to be uppermost on the frame, in use, for supporting an ice skate boot thereon, said platform comprising a first support for supporting a forward portion of an ice skate boot and a second support, separate from the first support, for supporting a rearward portion of an ice skate boot, wherein the elongate body comprises first and second arms extending therefrom, the first and second supports being connected to distal ends of the first and second arms, respectively; and forming a mounting arrangement on the elongate body for mounting a blade runner to the elongate body, wherein the platform and elongate body are integrally formed from a composite material.

The first and second plates may be formed by injection moulding or compression moulding.

The method may comprise the step of the step of mounting a blade runner to the mounting arrangement.

The method may comprise the step of integrally moulding the blade runner into the T-shaped body in step a).

BRIEF DESCRIPTION OF THE DRAWINGS

Embodiments will now be described with reference to the accompanying drawings, in which.

DETAILED DESCRIPTION

Figure 1:
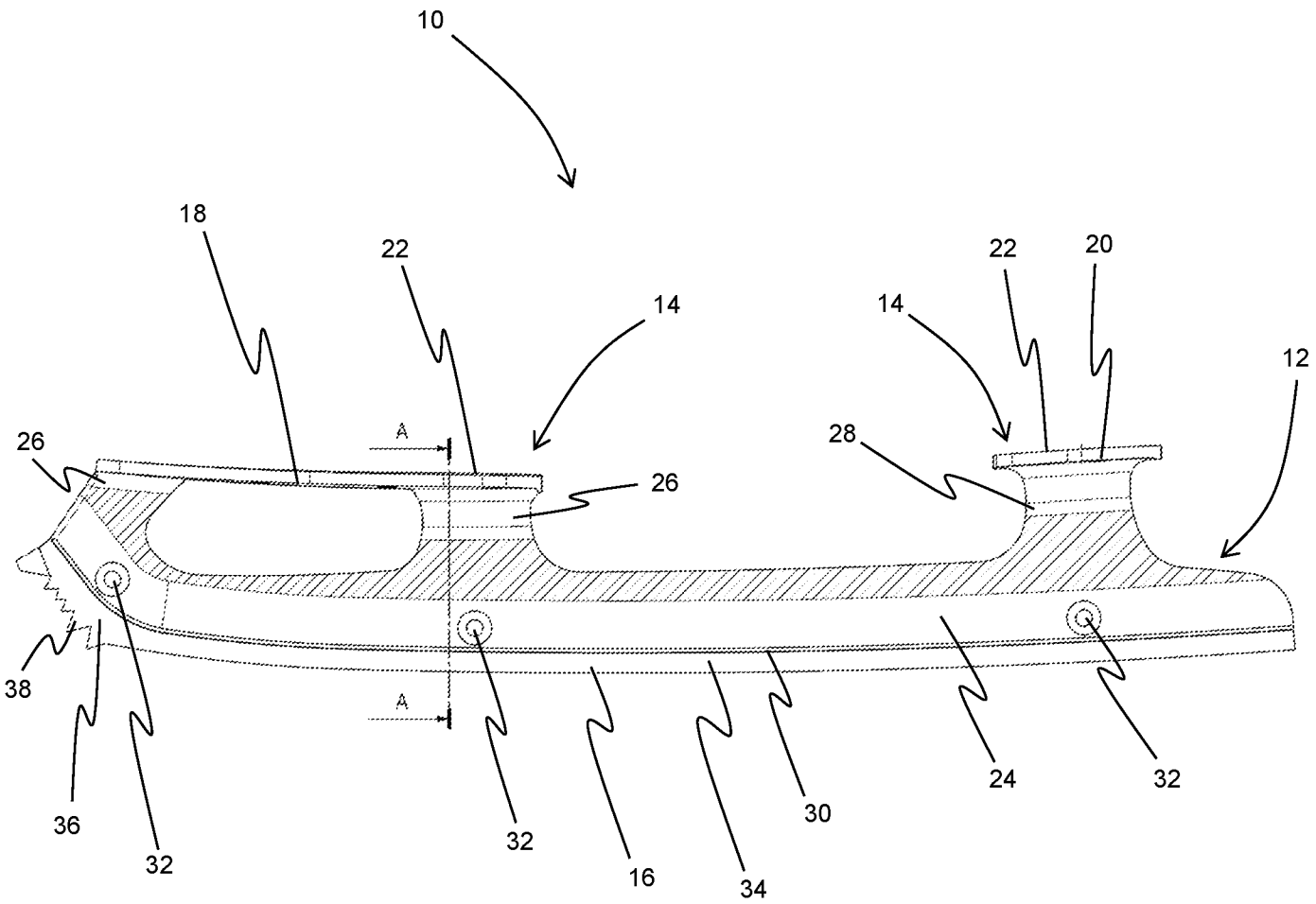
FIG. 1 is a side view of a support frame for an ice skate boot.

Referring to FIG. 1, a frame for an ice skate boot (not shown) is indicated generally at 10. The frame or support frame 10 is made up of an elongate body (i.e. a frame body) 12 and a platform 14 for supporting an ice skate boot. A blade runner 16 is mounted to the support frame 10 for engaging an ice surface to glide therealong. The platform 14 is intended to be uppermost on the support frame 10 so as to be capable of supporting an ice skate boot. The blade runner 16 is intended to be lowermost on the support frame 10 for engaging the ice surface.

The platform 14 includes a first support 18, commonly referred to as a sole plate or sole support, for supporting a forward, or sole, portion of an ice skate boot. The platform 14 also includes a second support 20, commonly referred to as a heel plate or heel support, for supporting a rearward, or heel, portion of an ice skate boot.

Put another way, the platform includes a front portion 18 and a rear portion 20 for supporting sole and heel portions of an ice skate boot, respectively.

It will be appreciated that the first and second supports 18, 20 may be configured (e.g. by the size and shape thereof) to provide a sufficient contact area with the outsole of an ice skate boot (i.e. a bottom surface of an ice skate boot), so the ice skate boot can be attached to the support frame 10. Typically, the first and second supports 18, 20 include a plurality of holes (not shown) for receiving fasteners therethrough to secure an ice skate boot to the support frame 10.

The first and second supports 18, 20 are connected to each other via the frame body 12 such that the body 12 and first and second supports 18, 20 form a unitary body/component. Put another way, the first and second supports 18, 20 are provided as separate and discrete supports (i.e. the first and second supports are only connected via the elongate body) that are each connected to, and integrally formed with, the frame body 12.

The frame body 12 includes an elongate body portion 24. The elongate body portion 24 defines an elongate length of the support frame 10. Put another way, the elongate body portion 24 extends from the front to the rear of the length of the support frame 10. The elongate body portion 24 is connected to the first and second supports 18, 20 by first and second arms 26, 28, respectively. In the illustrated arrangement, the first support 18 is connected to the elongate body portion 24 by two arms 26. It will be appreciated that the first and second arms 26, 28 are provided as stanchions so as to support the first and second supports 18, 20.

The platform 14 (i.e. the first and second supports 18, 20) and the frame body 12 are integrally formed from a composite material. Put another way, the platform 14 (i.e. the first and second supports 18, 20) and the frame body 12 are provided as a unitary body formed from a composite material. This arrangement enables the weight of the support frame 10 to be reduced, whilst providing the same structural strength require for use in ice skating, such as figure skating. In some embodiments of the support frame 10, this has been found to result in a reduction in weight of up to almost 50% compared to a traditional metal support frame. It will be appreciated that the platform 14 and frame body 12 are integrally formed through injection moulding and/or compression moulding.

In the present arrangement, the composite material may include reinforcing fibres within a thermoset resin such as an epoxy. The composite material may be a carbon fibre reinforced composite material, for example a carbon fibre reinforced epoxy. The use of carbon fibre reinforced composite materials can provide the equivalent stiffness and strength as the traditional steel structure at a much lighter weight. Thus, a strong support frame 10, and so a strong ice skate, can be obtained. Composite materials such as carbon fibre reinforced materials are known to dampen vibrations more effectively than metals, and so the resulting support frame 10 of the present invention is able to provide improved performance, when compared to traditional metal, e.g. steel and/or aluminium, frames. Composite materials such as carbon fibre reinforced materials are also known to provide better thermal insulation when compared to traditional metal materials, which helps to insulate a wearer's foot from the cold ice below.

In order to be able to mount the blade runner 16 to the support frame 10, the elongate body portion 24 is provided with a mounting arrangement for mounting said blade runner 16. It will be appreciated that the blade runner 16 may be formed from a metal material, such as steel. The mounting arrangement is provided along an edge 30 of the elongate body 24 that is distal to the platform 14. Put another way, the mounting arrangement is provided along a bottom edge 30 of the elongate body 24.

The blade runner 16 may be removably mounted to the mounting arrangement. This enables the blade runner 16 to be manufactured as a separate component to frame body 12, and so to be manufactured from different materials.

The blade runner 16 is mounted to the mounting arrangement via an adhesive, e.g. a structural adhesive. As is illustrated, the blade runner 16 is mounted to the mounting arrangement via one or more fasteners 32. The blade runner 16 and the elongate body portion 24 each include one or more apertures (corresponding to the number of fasteners 32), and each aperture of the elongate body portion 24 is arranged to align with a corresponding aperture of the blade runner 16 to enable a fastener 32 to extend therethrough. In the arrangement shown, three fasteners 32 are provide, but any suitable number of fasteners 32 may be used. In some arrangements, no fasteners 32 may be provided and the blade runner 16 may be mounted to the mounting arrangement only by an adhesive.

The blade runner 16 includes a substantially straight rear portion 34 and a front portion 36. The front portion 36 is angled upwardly so as to define an angled front surface. This front portion 36 is typically angled at approximately 45° to the substantially straight rear portion 34. The front portion 36 is provided with a plurality of teeth 38 projecting therefrom. The teeth 38 are provided so as to form a toe pick which may be used to engage the ice.

Figure 2:
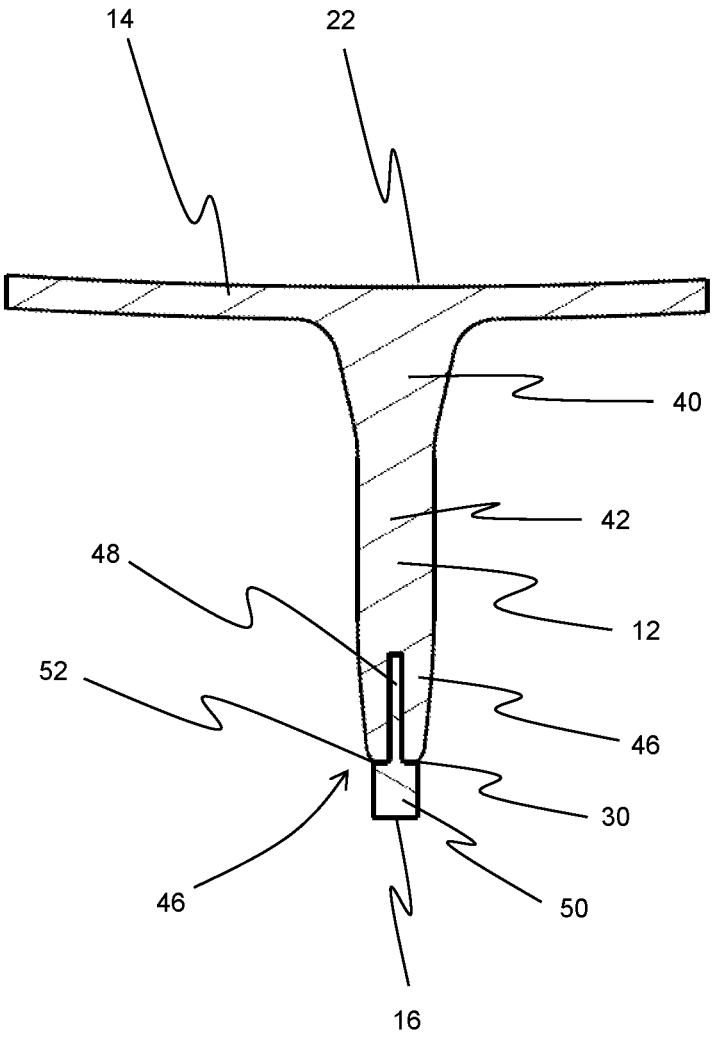
FIG. 2 is a cross-sectional view of the support frame of FIG. 1 through the line A-A.

Referring now to FIG. 2, the support frame 10 is substantially T-shaped in cross-section. Put another way, the frame body 12 extends substantially perpendicularly from the platform 14 such that the platform and elongate body are substantially T-shaped in cross-section.

The platform 14 (i.e. the first and second supports 18, 20) is curved so as to conform to an underside of an ice skate boot. The upper surface 22 of the platform 14 defines a convexly curved surface. Put another way, the upper surface 22 of the platform 14 is curved such that the lateral sides of said platform 14 are raised above a central region of said platform 14. In alternative arrangements, it will be appreciated that the upper surface 22 of the platform 14 may be substantially flat The frame body 12 defines a width in cross-section, and the width of the frame body 12 decreases from a maximum adjacent to the platform 14 to a minimum adjacent to the bottom edge 30 of the elongate body portion 24. Put another way, the width of the frame body 12 decreases in a direction away from the platform 14. Providing a maximum width of the frame body 12 at or near to the junction with the platform 14 increases the strength provided at this junction, which is exposed to very high levels of stress during ice skating.

The upper region 40 of the frame body 12 (i.e. the region of the frame body adjacent to the platform 14) is tapered in a direction away from the platform 14.

Below this upper region 40, the frame body 12 includes a clamping region 42. The clamping region 42 is provided as a region of the frame body 12 where opposing sides/surfaces of the frame body 12 are arranged so as to be substantially parallel. The provision of parallel sides has been found to facilitate clamping onto the support frame 10, e.g. to facilitate maintenance of the blade runner.

The clamping region 42 extends along the elongate length of the frame body 12, e.g. along the entirety of the elongate length of the frame body 12. This clamping area 42 is indicated by the hatching in FIG. 1.

Below this clamping region 42, the frame body 12 includes a lower region 44. The lower region is tapered in a direction away from the platform (i.e. away from the clamping region 42). A bottom, or distal, edge of the lower region defines the lower edge 30 of the frame body 12.

As has been discussed above, the mounting arrangement is provided along the bottom edge 30 of the frame body 12 (i.e. of the elongate body 24).

The mounting arrangement includes a longitudinal slot 46 extending along the length of the bottom edge 30. The longitudinal slot 46 extends along substantially an entirety of the bottom edge 30.

The longitudinal slot 46 defines a recess within the frame body 12 that extends upwardly from the bottom surface 30 of the elongate body portion 24. As is illustrated, the recess is dimensioned so that it is able to locate at least a portion of the blade runner 16 therein.

The elongate slot 46 defines a height that is it extends up from said bottom surface 30. In the present arrangement, the height of the elongate slot 46 may be in the range 5-15 mm, for example approximately 10 mm. Providing an elongate slot having these heights has been found to provide a large enough contact area between the frame body 12 and the blade runner 16 to produce a strong bond (e.g. via an adhesive) therebetween.

The elongate slot 46 defines a width. The blade runner 16 includes a first, or upper, region 48 having a first width. This first width of the blade runner 16 is arranged so as to be substantially the same as the width of the elongate slot 46 so as to provide a close fit therebetween.

The blade runner 16 includes a second, or lower region 50, intended to be positioned below the first region 48, in use. The second region 50 is arranged to have a greater width that the first region 48. The arrangement of the first and second region 48, 50 of the blade runner 16 forms a shoulder 52 therebetween. When the blade runner 16 is mounted to the mounting arrangement, the shoulder 52 abuts against the opposing sides of the slot 46 (i.e. against the bottom surface 30).

Figure 3:
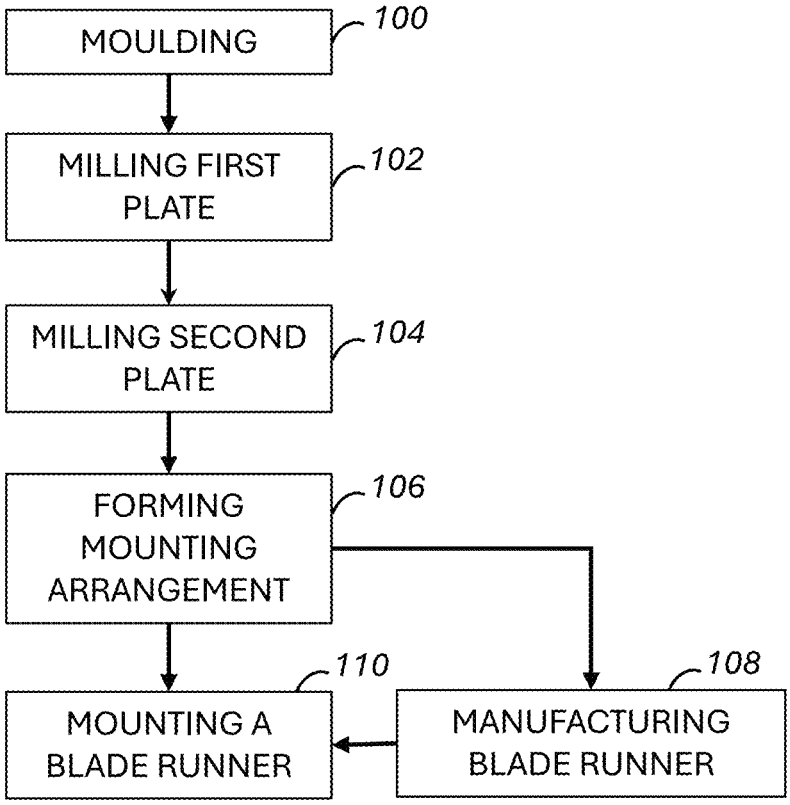
FIG. 3 is a flow chart of the present method.

Referring now to FIG. 3, methods of manufacturing a support frame 10 for an ice skate boot will now be discussed.

As has been discussed above, the material used to form the support frame is a composite material. The composite material may include reinforcing fibres within a thermoset resin such as an epoxy. The composite material may be a carbon fibre reinforced composite material, for example a carbon fibre reinforced epoxy. Such an epoxy material is able to be readily cured with the application of heat and pressure.

Initially, at step 100, a mould having a substantially T-shaped cross-sectional profile is produced. A composite material is poured/deposited into the mould and said material is then cured in the mould. It will be appreciated that the material may be cured via injection moulding, compression moulding or any other suitable moulding process.

Once cured, the material is removed from the mould and a substantially T-shaped body produced. The body produced includes a first plate and a second plate extending from said first plate so as to define the substantially T-shaped cross-section. It will be appreciated that the process of forming the T-shaped body integrally forms the first and second plates as a unitary body.

In some arrangements, it will be appreciated that the first plate may be curved so as to conform to an underside of an ice skate boot. The upper surface of the first plate may be provided as a convexly curved surface. Put another way, the first plate may be curved such that the lateral sides of said first plate are raised above a central region of said first plate. In alternative arrangements, the first plate may be substantially planar (i.e. flat).

In some arrangements, it will be appreciated that the second plate may be formed so as to define opposing side walls having a similar cross-sectional profile the profile of the frame body 12 discussed with reference to FIG. 2. In alternative arrangements, the second plate may be substantially flat, and a desired cross-sectional profile may be machined into said first plate.

Following the formation of the T-shaped body, the method further includes at step 102 the step of milling/machining the first plate to form a platform 14 for supporting an ice skate boot. It will be appreciated that the process of milling the platform 14 may include the steps of milling a first support 18 for supporting a forward, or sole, portion of an ice skate boot and a second support 20 for supporting a rearward, or heel, portion of an ice skate boot.

The process may also include at step 104 the step of milling/machining the second plate to form a frame body 12. The milling process may include forming a frame body 12 having an elongate body portion 24 defining an elongate length of the support frame 12, and first and second arms 26, 28 extending from said elongate body portion 24 and connected to the first and second supports 18, 20.

It will be appreciated that as a part of the manufacturing process, at step 108 a blade runner will be manufactured, for example from a metal material such as steel. The blade runner 16 may include a substantially straight rear portion 34 and a front portion 36. The front portion 36 may angled upwardly so as to define an angled front surface. This front portion 36 may be typically angled at approximately 45° to the substantially straight rear portion 34. The front portion 36 may be provided with a plurality of teeth 38 projecting therefrom. The teeth 38 may be provided so as to form a toe pick which may be used to engage the ice.

The manufacturing process also includes at step 106 forming of a mounting arrangement in the second plate (i.e. extending along an edge, such as a bottom edge, of the first plate). A blade runner will then be mounted to the mounting arrangement. In order to mount the blade runner 16 to the mounting arrangement, the process may include the step of coating one or more surfaces of the blade runner with an adhesive.

It will be appreciated that in some arrangements, the blade runner may be positioned within the mould during the moulding of the T-shaped body. In this way, the blade runner may, at step 110 be mounted to the resulting frame body during the moulding process. In alternative arrangements, it will be appreciated that the mounting formation may be milled/machined into the second plate of the T-shaped body after the moulding process. In exemplary arrangements, the second plate may also be then machined to produce one or more apertures to receive fasteners therethrough.

It will be appreciated that in an alternative method of manufacturing a support frame 12 for an ice skate, the mould may be designed to provide the structure of the platform 14 and frame body 12 without subsequent milling/machining.

Although the teachings have been described above with reference to one or more preferred embodiments, it will be appreciated that various changes or modifications may be made without departing from the scope as defined in the appended claims.

The invention claimed is:

1. A method of manufacturing a frame for an ice skate boot, the method comprising:

a) moulding a substantially T-shaped body comprising a first plate and a second plate extending substantially perpendicularly from said first plate;

b) milling the first plate to form a platform intended to be uppermost on the frame, in use, for supporting the ice skate boot, said platform comprising a first support for supporting a forward portion of the ice skate boot and a second support for supporting a rearward portion of the ice skate boot, wherein the second support is separate from the first support;

c) milling the second plate to form an elongate body defining an elongate length of the frame, said elongate body comprising first and second arms extending from the elongate body, where distal ends of said first and second arms are connected to the first and second supports, respectively; and d) forming a mounting arrangement on the elongate body for mounting a blade runner to the elongate body, wherein step a) comprises a step of integrally forming the first and second plates from a composite material.

2. The method according to claim 1, wherein in step a) the T-shaped body is formed by injection moulding or compression moulding.

3. The method according to claim 1, comprising a step of mounting a blade runner to the mounting arrangement, wherein mounting the blade runner comprises coating one or more surfaces of the blade runner with an adhesive.

4. The method according to claim 1, comprising a step of mounting a blade runner to the mounting arrangement, wherein mounting the blade runner comprises positioning the blade runner within a mould used in step a) during the moulding of the T-shaped body such that the blade runner is integrally moulded into the mounting arrangement of the T-shaped body.

5. The method according to claim 1, wherein forming the mounting arrangement comprises milling or moulding the second plate to comprise a longitudinal slot extending generally along a longitudinal edge of the elongate body distal to the first plate.

6. The method according to claim 5, wherein forming the mounting arrangement comprises milling or moulding the longitudinal slot to comprise a depth in the range 5-15 mm, optionally approximately 10 mm.

7. The method according to claim 5, comprising manufacturing a blade runner to comprise a first region defining a first width substantially the same as a width of the elongate slot and a second region defining a second width greater than the first width and intended to be positioned below the first region, in use, wherein the method comprises positioning the first region of the blade runner within the elongate slot.

8. The method according to claim 7, comprising a step of positioning the blade runner in the mounting arrangement such that a shoulder formed between the first and second regions abuts against an edge of the elongate slot.

9. The method according to claim 1, comprising integrally forming the first and second plates from a fibre reinforced composite material.

10. The method according to claim 1, comprising integrally forming the first and second plates from a carbon fibre reinforced composite material.

11. The method according to claim 1, comprising integrally forming the first and second plates from a carbon fibre reinforced resin material, optionally a carbon fibre reinforced epoxy resin.

12. The method according to claim 1, wherein in step a), the second plate is moulded to define a profile in cross-section, and wherein said profile comprises a clamping region in which opposing sides of the profile are substantially parallel.

13. The method according to claim 12, wherein the second plate is moulded such that the profile defines a width that is tapered in a direction from the first plate to the clamping region.

14. The method according to claim 12, wherein the second plate is moulded such that the profile defines a width that is tapered in a direction from the clamping region to an edge of the second plate distal to the first plate.

15. The method according to claim 1, wherein in step c), the second plate is milled to define a profile in cross-section, and wherein said profile comprises a clamping region in which opposing sides of the profile are substantially parallel.

16. The method according to claim 15, wherein the second plate is milled such that the profile defines a width that is tapered in a direction from the first plate to the clamping region.

17. The method according to claim 15, wherein the second plate is milled such that the profile defines a width that is tapered in a direction from the clamping region to an edge of the second plate distal to the first plate.

18. The method according to claim 12, wherein the clamping region is substantially planar and substantially extends along an entirety of the longitudinal length of the elongate body.

19. The method according to claim 1, wherein moulding a substantially T-shaped body comprises moulding the first plate to define a substantially convexly curved upper surface for conforming to an underside of the ice skate boot, in use.

* * * * *